US009137858B2

(12) United States Patent
Lewin

(10) Patent No.: US 9,137,858 B2
(45) Date of Patent: Sep. 15, 2015

(54) ELECTRIC HEATING DEVICE

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 815 days.

(21) Appl. No.: 12/746,694

(22) PCT Filed: Dec. 10, 2007

(86) PCT No.: PCT/SE2007/050962

§ 371 (c)(1),
(2), (4) Date: Jun. 7, 2010

(87) PCT Pub. No.: WO2009/075616

PCT Pub. Date: Jun. 18, 2009

(65) Prior Publication Data

US 2010/0290499 A1 Nov. 18, 2010

(51) Int. Cl.

| | |
|---|---|
| ***H05B 3/48*** | (2006.01) |
| ***H05B 3/62*** | (2006.01) |
| ***H05B 3/02*** | (2006.01) |
| ***H05B 3/06*** | (2006.01) |

(Continued)

(52) U.S. Cl.

CPC ..... *H05B 3/64* (2013.01)

(58) Field of Classification Search

CPC ..... H05B 3/00; H05B 3/04; H05B 3/06; H05B 3/10; H05B 3/14; H05B 3/16; H05B 3/42; H05B 3/44; H05B 3/46; H05B 3/62; H05B 3/64; H05B 3/68; H05B 3/80; H05B 3/82; F27D 2099/0011; F27D 99/0006; F27D 11/02

USPC ..... 373/127, 128, 37, 117, 28, 111, 120, 373/131, 133, 134, 137; 219/553, 548, 552, 219/644, 481, 546, 544, 538, 542, 523, 520, 219/619, 550, 536, 537, 539, 668, 503, 219/530; 392/480, 487, 488, 432, 497; 432/65, 102, 112, 114, 116

See application file for complete search history.

(56) References Cited

U.S. PATENT DOCUMENTS

| | | | | |
|---|---|---|---|---|
| 1,432,064 | A * | 10/1922 | Hadaway, Jr. | 219/552 |
| 2,784,292 | A * | 3/1957 | Haloski | 219/534 |
| 3,305,820 | A * | 2/1967 | Lennox | 219/523 |

(Continued)

FOREIGN PATENT DOCUMENTS

| | | |
|---|---|---|
| FR | 2612723 | 3/1987 |
| JP | 51-51028 | 6/1976 |

(Continued)

OTHER PUBLICATIONS

Notice of Reasons for Rejection (with English translation) for Japanese Patent Application No. 2010-537887, dated Dec. 18, 2012.

(Continued)

*Primary Examiner* — Hung D Nguyen

(74) *Attorney, Agent, or Firm* — Morgan, Lewis & Bockius LLP

(57) ABSTRACT

Electric heating device with a radiant tube and an electrical heating element arranged in the radiant tube as well as a protective insert of electrically conductive material. The protective insert is arranged between the radiant tube and the electrical heating element. The device allows the use of higher element power.

16 Claims, 3 Drawing Sheets

(51) Int. Cl.
*H05B 3/10* (2006.01)
*H05B 3/64* (2006.01)

(56) References Cited

U.S. PATENT DOCUMENTS

| | | | | | |
|---|---|---|---|---|---|
| 3,663,799 | A | * | 5/1972 | McArn | 219/523 |
| 4,016,403 | A | * | 4/1977 | Best | 219/550 |
| 4,236,139 | A | | 11/1980 | Haglund | |
| 4,300,038 | A | * | 11/1981 | Schwarzkopf | 219/544 |
| RE30,838 | E | * | 12/1981 | Best | 219/550 |
| 4,562,337 | A | * | 12/1985 | Lawrence | 219/421 |
| 5,473,141 | A | | 12/1995 | Makris et al. | |
| 6,034,354 | A | * | 3/2000 | Hironaka | 219/383 |
| 2002/0047002 | A1 | | 4/2002 | Wheeler | |
| 2006/0071606 | A1 | * | 4/2006 | Kawai | 315/94 |
| 2006/0086724 | A1 | * | 4/2006 | Yamamoto et al. | 219/619 |
| 2006/0091132 | A1 | * | 5/2006 | Arold et al. | 219/497 |
| 2007/0023418 | A1 | * | 2/2007 | Schlipf | 219/532 |

FOREIGN PATENT DOCUMENTS

| | | |
|---|---|---|
| JP | 60-21699 | 2/1985 |
| JP | 61-66891 | 5/1986 |
| JP | 61-142685 | 6/1986 |
| JP | 63-149090 | 9/1988 |
| JP | 2-143795 | 12/1990 |
| JP | 03-046785 | 2/1991 |
| WO | 2005/006812 | 1/2005 |

OTHER PUBLICATIONS

Office Action for European Application No. 07852234.9 dated Dec. 10, 2014.

European Search Report from Application No. 07852234.9 dated Oct. 24, 2014.

* cited by examiner

ELECTRIC HEATING DEVICE

The present invention is generally related to an electric heating device comprising a radiant tube as well as a heating element comprising heating wire.

U.S. Pat. No. 5,473,141 describes an example of an electric heating device which comprises a radiant tube as well as an element with many legs of heating wire running back and forth in the tube. The element is supported in the radiant tube by ceramic plates provided with bores through which the element's legs pass.

Another example of an electric heating device of this sort is described in WO 2005/006812. Even in this case the electric heating device comprises a radiant tube and an electrical heating element with many legs running back and forth in the tube and the element is supported in the tube by ceramic plates provided with bores through which the element's legs pass.

A further example of an electric heating device is described in U.S. Pat. No. 4,236,139. In this case the electric heating device comprises a radiant tube as well as a spiral shaped heating element which is supported in the tube by a core.

In this sort of electric heating device the electrical heating elements are subject to large stresses, which can lead to element failure after a period of use. Element failure can occur due to the tensile and compressive forces which the element is subject to because of the thermal expansion of the heating wire. Another example of causes of element failure is ageing and overloading in the form of power output and/or process temperature.

During an element failure a wire break will occur. This wire break is accompanied by an electrical arc between the surface failure and the proximate heating wire, which in turn can lead to melting of metal in the heating wire. The molten metal which is generated falls down and welds firmly to the inner surface of the radiant tube.

It can even occur that the electrical arc is formed between the wire and/or the wire's surface failure and the radiant tube's inner surface. This leads to the electrical arc melting the heating wire and/or the inner surface of the radiant tube. In the worst case the electrical arc can lead to burning through of the radiant tube.

The risk for element failure means that electric heating devices of this type are often utilised at a lower power than what is actually possible. It is therefore a first object of the present invention to make possible higher power output with an electrical heating apparatus. A further object of the invention is to avoid unnecessary damage to the radiant tube due to element failure, that is, to minimise the consequences.

SUMMARY

The above-noted objects are accomplished through an electric heating device comprising a radiant tube, an electrical heating element arranged in the radiant tube where the electrical heating element comprises heating wire running in the radiant tube, the heating element is connected to current outlets at one end of the radiant tube and the heating element is supported in the radiant tube with the help of a support. The electric heating device further comprises a protective insert of electrically conductive material which is arranged between the radiant tube and the electrical heating element.

The primary purpose of the protective insert is to function as protection for the radiant tube against molten metal in the event of element failure. The insert also prevents the potential formation of an electrical arc between the heating wire's surface failure and the radiant tube where the protective insert is located since the electrical arc forms instead between the heating wire's surface failure and the protective insert. The consequences of a potential element failure are in this way reduced. Thus this allows use of the heating device at higher power since the safety margin used by the prior art can be reduced.

In the event of an element failure the element and protective insert can easily be removed from the radiant tube and replaced. The damages and possible molten residues are carried out by the protective insert.

According to one embodiment the protective insert even functions as a current conductor and is therefore grounded, preferably in connection to the radiant tube's tube flange.

DETAILED DESCRIPTION

The invention will now be described in connection with the figures.

Figure 1A:
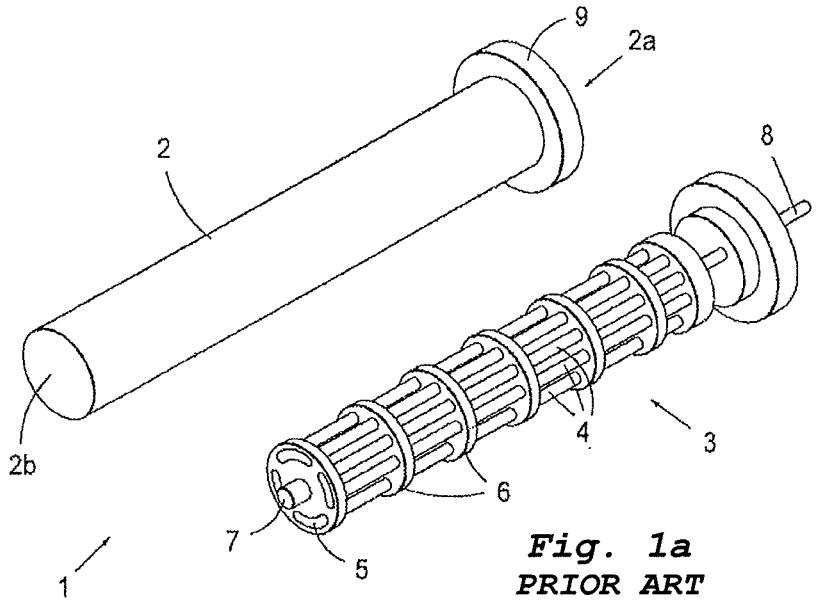
Fig. 1a PRIOR ART
FIG. 1*a* shows an electric heating device according to the prior art where the heating element is removed from the radiant tube.
Figure 1B:
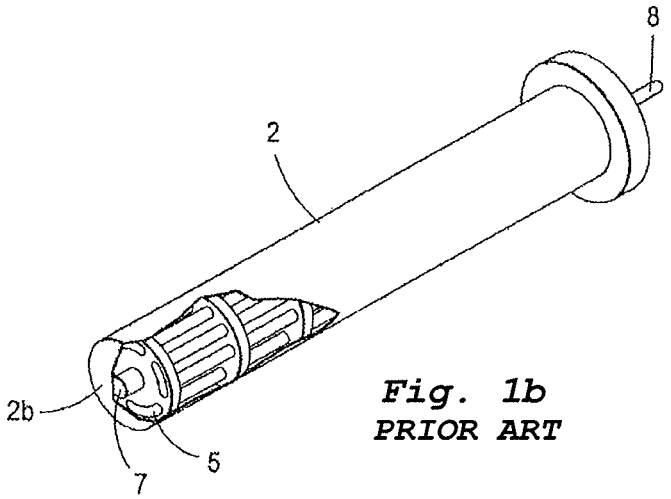
Fig. 1b PRIOR ART
FIG. 1*b* shows an electric heating device according to the prior art.

FIGS. 1*a* and 1*b* show an electric heating device 1 according to the prior art. In FIG. 1*a* the heating element is separated from the radiant tube to clearly illustrate their conformation, while FIG. 1*b* shows how the heating element is arranged in the radiant tube during use. The electric heating device comprises a radiant tube 2 with a closed end 2*b* and an open end 2*a*. The radiant tube's open end 2*a* is intended to be in proximity of a furnace wall. An electrical heating element 3 is arranged in the radiant tube 2 via the open end 2*a*. I the FIGS. 1*a* and 1*b* the electrical heating element 3 is composed of a number of legs 4 of heating wire which passes back and forth in the radiant tube 2 and are connected to each other via sections 5 provided in the proximity of the closed end of the radiant tube 2. The electrical heating element can also have other forms. It can for example be a helical element which surrounds a grooved or smooth ceramic core, either with good conformity or where the ceramic is only located in the upper part of the enclosed space of the helix, that is, helix on ceramic bearing tube.

Current outlets 8 (only the first shown in the figures), through which the electric element 3 is provided with electric current, are arranged in the radiant tube's open end 2*a*. The heating element is suitably supported in the radiant tube 2 with help from ceramic discs 6 provided with bores in which the element's legs 4 pass. The heating element 3 can further be supported in the radiant tube 2 with help from a central rod 7 which runs centrally in the radiant tube 2 and through the central bores in the ceramic discs 6. The radiant tube further comprises a tube flange 9 provided primarily to hold the radiant tube 2 in place in the furnace, but often also provided to constitute a seal between the furnace atmosphere and the standard atmosphere/air outside the furnace. The flange is often arranged against the furnace wall via a bolted joint and can be grounded through that. In some cases the tube flange can be connected via a cable to the furnace wall, which is itself grounded, and in that way the tube is grounded.

The heating device according to the present invention comprises a radiant tube as well as a heating element comprising heating wire. A protective insert is arranged between the radiant tube and the heating element such that, in the event of an element failure, potential element residue and molten metal fall down on the protective insert with the help of gravity.

Figure 2:
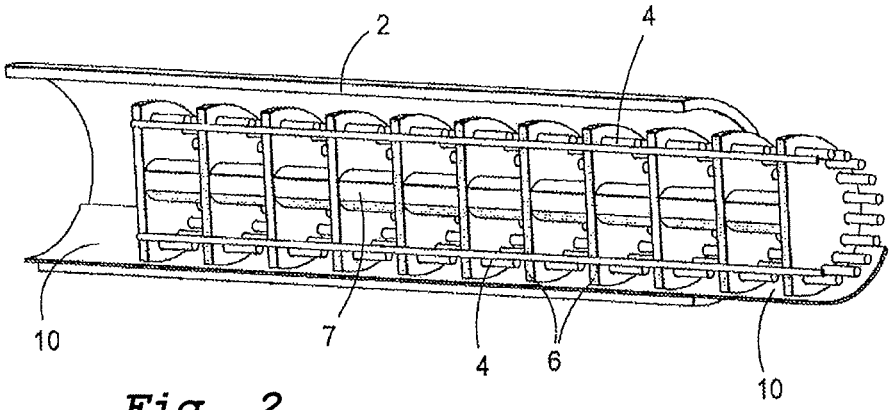
FIG. 2 shows an electric heating device comprising a protective insert according to the invention.

FIG. 2 shows a heating device according to an embodiment of the invention. The heating device comprises an electrical heating element with legs of heating wire 4 running back and forth in a radiant tube 2. The electrical heating element is connected to a current outlet (not shown) at the radiant tube's 2 first end and the heating element is supported in the radiant tube by a support, shown in the figure in the form of ceramic discs 6 provided with bores through which the element's legs pass. The heating device in FIG. 2 also has a central rod 7. The heating element according to this embodiment is intended for horizontal mounting in a furnace. It should be noted that the heating element can have another shape than that shown in the figures since the invention is also suitable for other types of heating elements comprising heating wire where a risk of contact between heating wire and the radiant tube exists.

A protective insert 10 is arranged between the radiant tube and the electrical heating element in such a way that it is removable with regard to the radiant tube. The protective insert 10 can also be removable with regard to the electrical heating element. The protective insert 10 has a function of collecting the remains of molten metal during a potential element failure and is therefore placed inside the radiant tube in such a way that molten metal from heating wire and/or the radiant tube falls down on the protective insert 10 due to gravity. The protective insert 10 also has the function of collecting possible pieces of heating wire which have loosened from the electrical heating element due to the element failure.

In the event of an element failure the electrical heating element can easily be released from the radiant tube and replaced together with the protective insert. The protective insert carries out the damage, such as pieces of the heating wire that have loosened from the electrical heating element, and possible molten residues. Even in the case of a possible burning through the protective insert it will be easier to remove the molten residues together with the protective insert. Because of the thermal mass of the protective insert the region which is subjected to surface welding will have a reduced extension compared with previously known heating elements without a protective insert. Further, it is easy to get a grip on the protective insert which makes it possible to break off or even draw out material which is welded to the radiant tube.

The protective insert should have good heat conductivity, that is, to be electrically conductive, to not affect the heat transfer from the electrical heating element to the radiant tube. It is also preferred to form the protective insert from a material which has a high emissivity, such as at least 0.6.

Figure 3A:
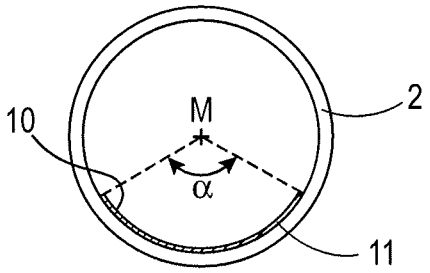
FIGS. 3*a* and 3*b* show cross sections of an electric heating device comprising a protective insert according to the invention.
Figure 3B:
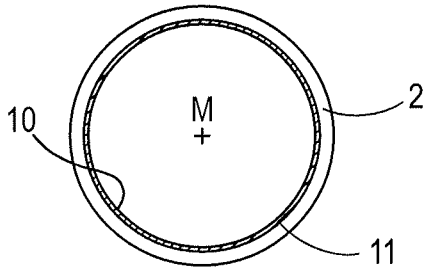
Figure 4:
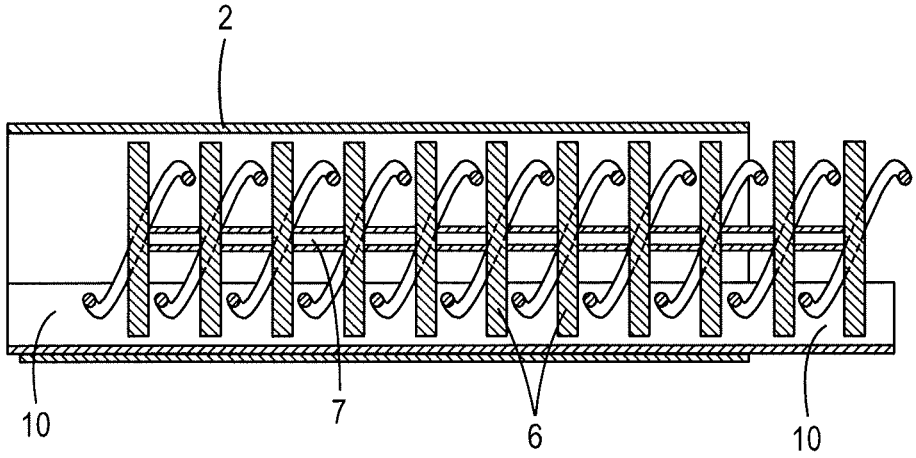
FIG. 4 shows the electric heating device as in FIG. 2, but with a helical shaped electrical heating element.

One preferred embodiment is shown in FIG. 3. The figure shows a cross section of the radiant tube 2 and the protective insert 10. An electrical heating element (not shown) is provided inside the radiant tube in the same way as described above. According to this embodiment the protective insert 10 can be configured in such a way so that when seen from a cross section of the electric heating device's axial length, that is, the radiant tube's 2 axial length, generally has the shape of a circular arc with a central angle $\alpha$ of up to 45°, where the midpoint M for the protective insert lies along the central axis for the radiant tube. The angle $\alpha$ should be made as small as possible to hinder heat radiating from the electrical heating element to the radiant tube as little as possible, although it must be sufficiently large so that the protective insert can fulfil its function. According to a preferred embodiment the protective insert is therefore formed in such a way that it constitutes a circular arc with a central angle $\alpha$ of 20-40°, typically about 30°.

In its simplest form the protective insert can be a plate. The plate is suitably rounded such that it follows the curvature of the inside of the radiant tube 11, such as illustrated in FIG. 3. A suitable thickness of the plate can be 1-5 mm.

According to a preferred embodiment the protective insert is arranged so that direct heat conduction occurs between the protective insert and the radiant tube. A gap between the protective insert and the radiant tube means that a radiation step occurs between the protective insert and the radiant tube which results in an unnecessary temperature increase in the heating element. By minimising the distance between the protective insert and the radiant tube in such a way that direct heat transfer occurs the working temperature of the heating element can therefore be lower, which then leads to a reduced risk for element failure. Direct heat transfer can be accomplished when the protective insert is in close contact with the inside of the radiant tube, preferably generally along the entire length of the protective insert in the radiant tube.

According to a further preferred embodiment the protective insert further functions as current conductor in the event of element failure. To achieve this, the protective insert is grounded, suitably in connection to the tube flange of the radiant tube. This can be achieved either through the protective insert being in close contact with the tube flange and/or radiant tube, or alternatively through a separate connection between the protective insert and the furnace wall, which is itself grounded. The dimensions of the protective insert are such that melting through of the protective insert does not occur before the heating element's fuse blows.

The heating element according to the invention therefore allows use of a higher power since a potential element failure will not cause such devastating consequences. In this way lower safety margins can be utilised in the choice of power outlet and the productivity in systems which use the heating device is therefore improved. The invention further makes it easier to change the electrical heating element and there is a possibility to save the radiant tube when changing an element. Hence, this extends the useful life of the heating device while at the same time it can be used at higher temperatures.

The protective insert can suitably be made from a ferric iron-based alloy comprising chromium and aluminium, such as an iron-based alloy comprising up to 0.1 weight % C, up to 0.8 weight % Si, up to 0.5 weight % Mn, 20-25 weight % Cr, 4-7 weight % Al and possibly up to 5 weight % of additives to increase the mechanical resistance. Examples of such alloys are known by the trade names Kanthal A-1, Kanthal AF och Kanthal APM. These sorts of iron-chromium-aluminium alloys are preferred since they have good oxidation resistance and suitable melting points. The above-mentioned materials also have high emissivity.

It is also contemplated to provide the protective insert in other types of material such as nickel-chrome-based alloys or of ceramic materials with good conductivity and an emissivity of preferably at least 0.6. An example of a suitable ceramic material is silicon carbide.

The invention is not limited to the above-mentioned embodiments but can vary within the parameters of an electric heating device comprising a radiant tube and an electrical heating element arranged in the radiant tube, wherein the electrical heating element consists of heating wire, the heating element is connected to current outlets at one end of the radiant tube and the heating element is supported in the radiant tube with the help of a support, the device comprising a protective insert of electrically conductive material, where the protective insert is arranged between the radiant tube and the electrical heating element. For example the protective insert can be comprised of a perforated plate wherein transfer of heat in the form of radiation to the radiant tube increases. Further the heating element can have other forms than those described above, for example to be helical shaped. The invention is applicable in all types of heating devices where the current carrier and/or the heating element could come in contact with the radiant tube. For example the electrical heating element can have more or fewer legs and the support can be provided in a different way. It is also possible that the electrical heating element is meandering wherein the heating elements legs are arranged transversely to, for example, ceramic discs which function as supports. Furthermore, it is possible to have a plurality of electrical heating elements arranged in the radiant tube, for example in the way described in WO 2005/006812.

An electric heating device for horizontal mounting in a furnace has been described above. However it is also contemplated to use the invention also for electrical heating elements which are intended to be mounted vertically in a furnace. Obviously, even in this case the protective insert is placed in the radiant tube so that, in the event of element failure, the potential pieces of heating wire and molten metal fall with the help of gravity down on the protective insert. In this way a spark-over between the heating wire and radiant tube is captured, and the risk for fusing or burning through is reduced. The protective insert in this case is preferably formed in such a way so that it even covers 360° of the radiant tube's inner circumference, that is, the protective insert is in the form of a tube inside the radiant tube. In this case the tube's inside will also function as a vertical splash guard for molten metal.

The invention claimed is:

1. An electric heating device comprising a radiant tube and an electrical heating element arranged in the radiant tube, wherein the electrical heating element consists of heating wire, the heating element is connected to current outlets at one end of the radiant tube and the heating element is supported internally in the radiant tube with a plurality of supports spaced along an axial length of the heating element, wherein the heating device comprises a protective insert of electrically conductive material, where the protective insert is arranged between the radiant tube and the electrical heating element and arranged in direct contact with an inner surface of the radiant tube and spaced from the heating element's heating wire, wherein the protective insert is removably arranged in the heating device such that molten metal or pieces of heating wire fall down on the protective insert with help of gravity in the event of element failure, wherein the protective insert is in line-of-sight communication with at least a portion of the heating wire, wherein the protective insert is arranged along the entire axial length of the heating element through the radiant tube, and wherein the protective insert is a rounded plate with an outer surface which has a curvature generally corresponding to the curvature of the inner surface of the radiant tube.

2. The electric heating device according to claim 1 wherein the protective insert is removably arranged with regard to the radiant tube.

3. The electric heating device according to claim 1 wherein the protective insert is removably arranged with regard to the electrical heating element.

4. The electric heating device according to claim 1 wherein the protective insert is grounded adjacent to one end of the radiant tube.

5. The electric heating device according to claim 1 wherein the protective insert is a perforated plate.

6. The electric heating device according to claim 1 wherein the protective insert is arranged such that it, when viewed in cross section along the axial length of the heating element, generally has an extension in the form of a circular arc with a central angle $\alpha$ of up to 45° and where the midpoint M for the circular arc coincides with the centre axis of the radiant tube.

7. The electric heating device according to claim 6 wherein the central angle $\alpha$ is 20-40°.

8. The electric heating device according to claim 1 wherein the protective insert is arranged such that direct heat transfer occurs between the protective insert and the radiant tube.

9. The electric heating device according to claim 1 wherein the protective insert is made of an oxidation resistant ferric iron-based alloy comprising chromium and aluminum.

10. The electric heating device according to claim 1 wherein the protective insert is made of ceramic material.

11. The electric heating device according to claim 1 wherein the electrical heating element has legs of heating wire running back and forth in the radiant tube.

12. The electric heating device according to claim 11 wherein the plurality of supports comprise at least one ceramic disc provided with bores through which the legs of the element pass.

13. The electric heating device according to claim 1 wherein the electrical heating element is helical shaped.

14. The electric heating device according to claim 1 wherein the heating device is adapted for horizontal mounting in a furnace.

15. The electric heating device according to claim 1 wherein the heating element is adapted for vertical mounting in a furnace.

16. The electric heating device according to claim 15 wherein the protective insert covers 360° of the inner circumference of the radiant tube.

* * * * *